US006325201B1

(12) United States Patent
Bailey et al.

(10) Patent No.: US 6,325,201 B1
(45) Date of Patent: Dec. 4, 2001

(54) BLANK HANDLING APPARATUS

(75) Inventors: Thomas William Bailey; Andrew John Cleall; Brian Hill, all of Coventry (GB)

(73) Assignee: Molins PLC, Milton Keynes (GB)

( * ) Notice: Subject to any disclaimer, the term of this patent is extended or adjusted under 35 U.S.C. 154(b) by 0 days.

(21) Appl. No.: 09/381,904

(22) PCT Filed: Mar. 26, 1998

(86) PCT No.: PCT/GB98/00932

§ 371 Date: Sep. 27, 1999

§ 102(e) Date: Sep. 27, 1999

(87) PCT Pub. No.: WO98/42604

PCT Pub. Date: Oct. 1, 1998

(30) Foreign Application Priority Data

Mar. 26, 1997 (GB) ..... 9706261

(51) Int. Cl.[7] ..... B65G 17/46

(52) U.S. Cl. ..... 198/471.1; 271/20

(58) Field of Search ..... 198/468.4, 468.2, 198/471.1; 221/277, 278, 211, 197; 271/20, 91, 92, 94, 96, 99, 104, 30.1, 145, 147

(56) References Cited

U.S. PATENT DOCUMENTS 5,080,341 * 1/1992 Luthy ..... 270/52

FOREIGN PATENT DOCUMENTS

2110963 * 3/1971 (DE) .
0 267 365 * 6/1987 (EP) .
0 405 107 A1 * 5/1990 (EP) .

* cited by examiner

*Primary Examiner*—Kenneth W. Noland
(74) *Attorney, Agent, or Firm*—Antonelli, Terry, Stout & Kraus, LLP

(57) ABSTRACT

Blank feeding apparatus, particularly in a hinged-lid cigarette packing machine, includes rotary blank pick-up means (36–42), and support means (44–50), rotatable with the pick-up means, for engaging and supporting the base of a blank stack in a magazine (2) between each pick-up operation. The pick-up means (36–42) may each comprise a pivotable arm (20–24), movable as it rotates by means of a pivoted follower member (60,62) engaging a fixed cam track (54). The blanks may be retained in the stack in the magazine (2) by pivotally-mounted support fingers (4,6) which are successively retracted to release a blank as the pick-up means (36–42) passes.

27 Claims, 13 Drawing Sheets

BLANK HANDLING APPARATUS

This invention relates to apparatus for handling blanks or other sheets, and particularly to apparatus for separating and conveying sheet-like blanks stored in a stack.

Various types of prior art blank feeding apparatus are known, in which blanks can be picked from a stack before being passed to a carton forming apparatus (for example). Generally, it is convenient to pick the blanks from the bottom of the stack, so that the magazine or feed box containing the stack of blanks can be easily filled from the top.

One aspect of the present invention provides apparatus for handling blanks comprising a magazine for receiving a stack of blanks and including means for supporting the stack, endless conveyor means for receiving successive lowermost blanks from the stack, said conveyor means including at least one blank pick-up device arranged to receive and convey blanks from the stack, and support means carried by the endless conveyor means for at least partly supporting the stack between pick-up operations of said pick-up device.

In a preferred arrangement the endless conveyor means is driven continuously, and may carry a plurality of spaced pick-up devices between which are arranged a plurality of spaced support members. The endless conveyor means may comprise a rotary member rotatable about an axis, which is parallel to a plane in which the lowermost blank of the stack extends. Each pick-up device may include an arm pivoted about an axis parallel to this axis and control means may be provided for controlling the angular position of the arm as the rotary member rotates about the axis. In this way, the arm may be arranged to reciprocate about its pivot axis so that a peripheral arcuate surface for receiving a blank performs a rolling action relative to the stack so as to receive a lowermost blank.

The support members may include arcuate surfaces at least approximately coaxial with the axis of said rotary member and arranged to engage successive lowermost blanks in the stack. The support members and pick-up devices may be so disposed as to allow a support member to engage the stack during a pick-up operation, i.e. as a blank is being withdrawn by a pick-up device the next blank is already being supported by the following support member.

A further aspect of the invention provides apparatus for handling blanks comprising a magazine for receiving a stack of blanks and including means for supporting the stack, endless conveyor means for receiving successive lowermost blanks from the stack, said conveyor means including at least one blank pick-up device arranged to receive and convey blanks from the stack, wherein said endless conveyor means comprises a rotary member rotatable about an axis and said pick-up device includes an arm pivoted about an axis parallel to said axis, and control means for controlling the angular position of the arm as said rotary member rotates about said axis.

Preferably each arm is arranged to reciprocate about its pivot axis, e.g. so as to pivot in the region of the magazine from a forward position to a rearward position, thereby providing a rolling action against the base of the stack. This pivotal motion of each arm may be achieved by a cam and follower arrangement, although it may also be achieved, for example, by suitable crank operated drive linkages. In a preferred arrangement a pivotable follower means is engaged with a fixed cam track: the follower means may be independently pivoted to the arm.

A still further aspect of the invention provides apparatus for handling blanks comprising a magazine for receiving a stack of blanks and including means for supporting the stack, endless conveyor means for receiving successive lowermost blanks from the stack, said conveyor means including at least one blank pick-up device arranged to receive and convey blanks from the stack, said supporting means including means for supporting opposed edges of the lowermost blank of the stack including retractable elements respectively at the leading and trailing edges of a lowermost blank, and means for sequentially retracting said elements in synchronism with movement of the pick-up device to receive said lowermost blank.

The supports for the opposed edges of the stack may comprise respective pivotally mounted support fingers at the leading and trailing edges of the lowermost blank, which are arranged to be successively retracted, as the blank is removed from the bottom of the stack, by a further cam drive mechanism.

One embodiment of the invention will now be described by way of example only, with reference to the accompanying diagrammatic drawings, in which.

Figure 1:
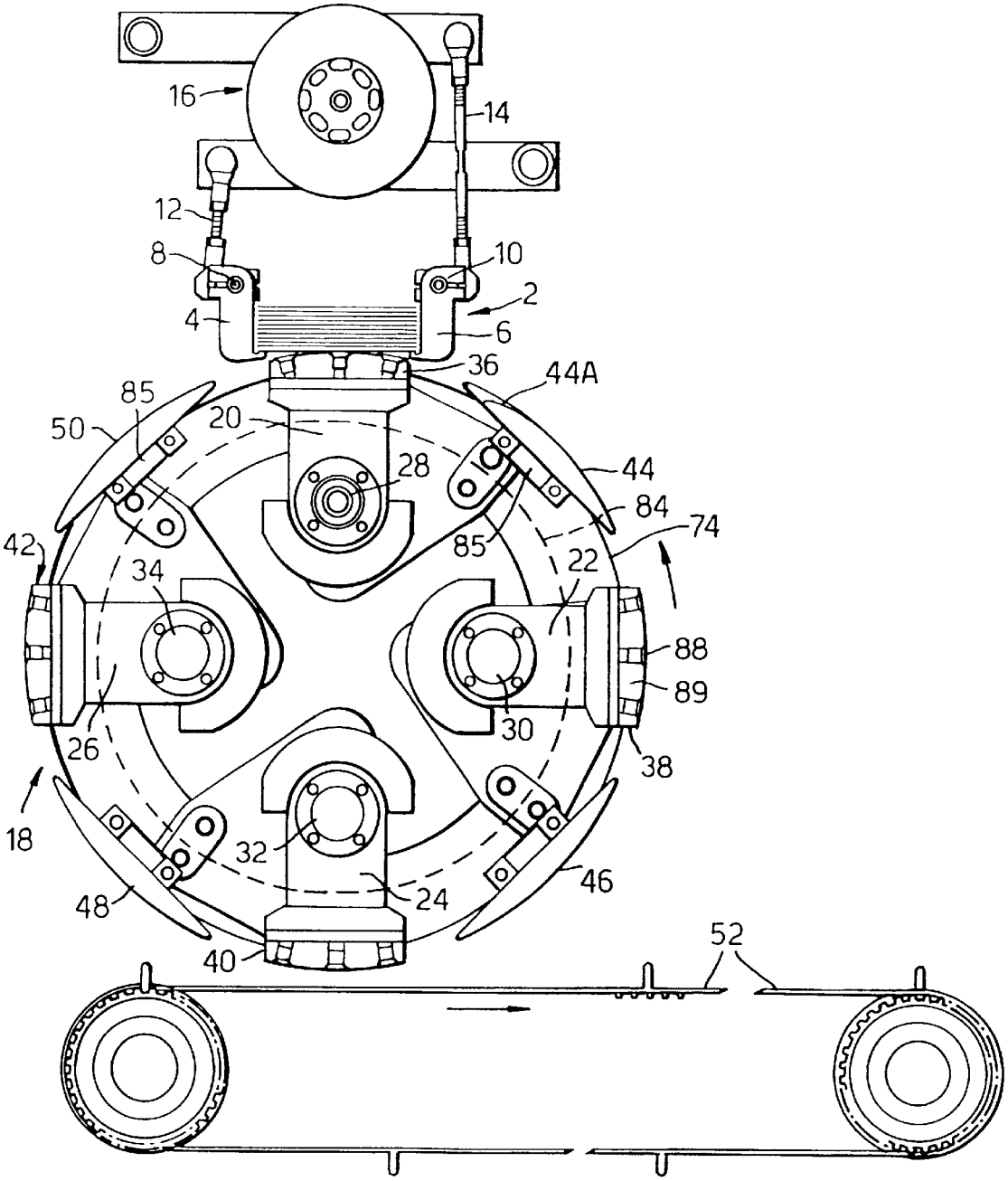
FIG. 1 is a schematic elevational view of a blank handling apparatus.

Referring to FIG. 1, which illustrates the overall layout of the apparatus, a magazine 2 containing a stack of blanks 3, e.g. card blanks for hinged lid cigarette packets, includes pairs of stack support fingers 4 and 6, which are pivotally mounted at 8 and 10 respectively on a cam driven mechanism which enables them to be retracted outwardly away from the stack, when required, as explained in more detail below. Respective links 12 and 14 are arranged to move the fingers 4, 6, in synchronism with the rest of the apparatus, via a cam drive mechanism indicated generally at 16.

Figure 4:
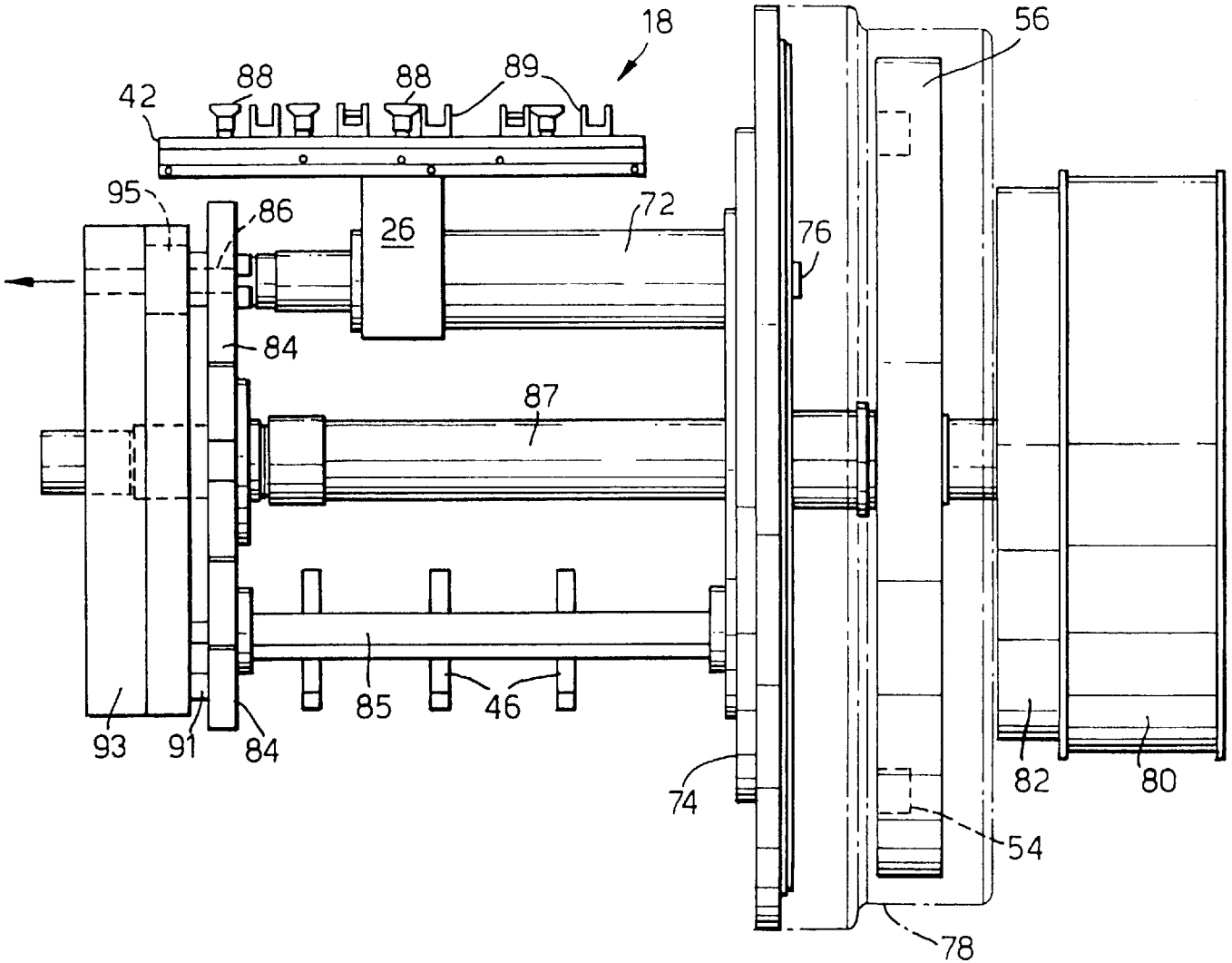
FIG. 4 is a part-sectional side elevation of a drive mechanism of the apparatus of FIG. 1.

A rotatable drum assembly 18 supports four pivotally mounted pick-up arms, indicated respectively at 20, 22, 24 and 26, between axially-spaced inner and outer drum plates 74 and 84 (see also FIG. 4). The arms are pivotally mounted on the plate 84 by means of journals 28, 30, 32 and 34 respectively, and carry at their outer ends respective suction pick-up heads 36, 38, 40 and 42. At each intermediate position of the drum assembly 18, between the pairs of pick-up heads, an outer guide or support member 44, 46, 48 or 50 is fixed to the drum assembly 18 so as to support the stack when it is not engaged by one of the pick-up heads.

Finally, beneath the drum assembly 18, a discharge conveyor 52 is arranged to receive blanks from the pick-up heads, in order to transport them to the next stage of the assembly operation.

Figure 2:
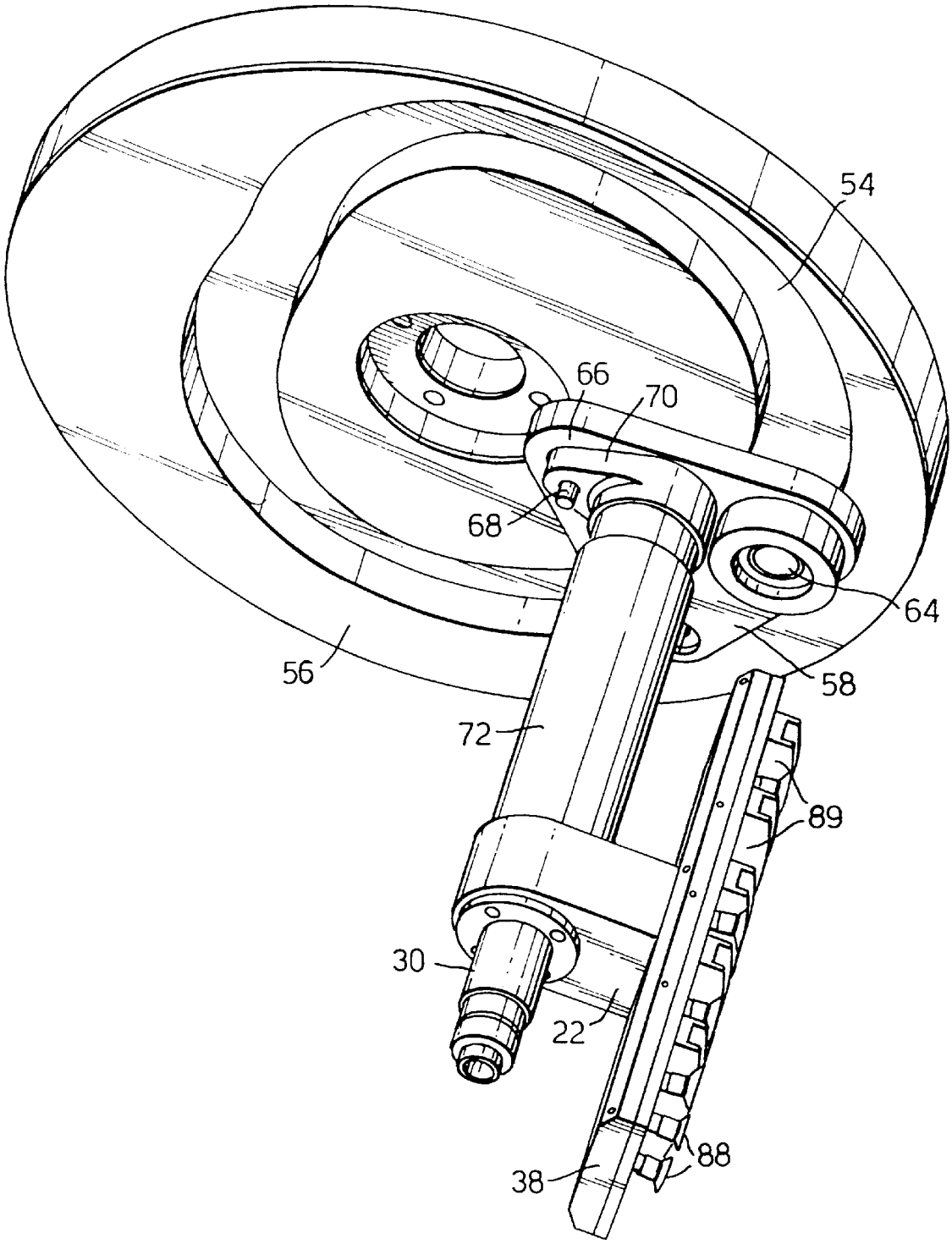
FIG. 2 is a perspective view of a pick-up arm assembly and an associated cam track in the apparatus of FIG. 1.
Figure 3:
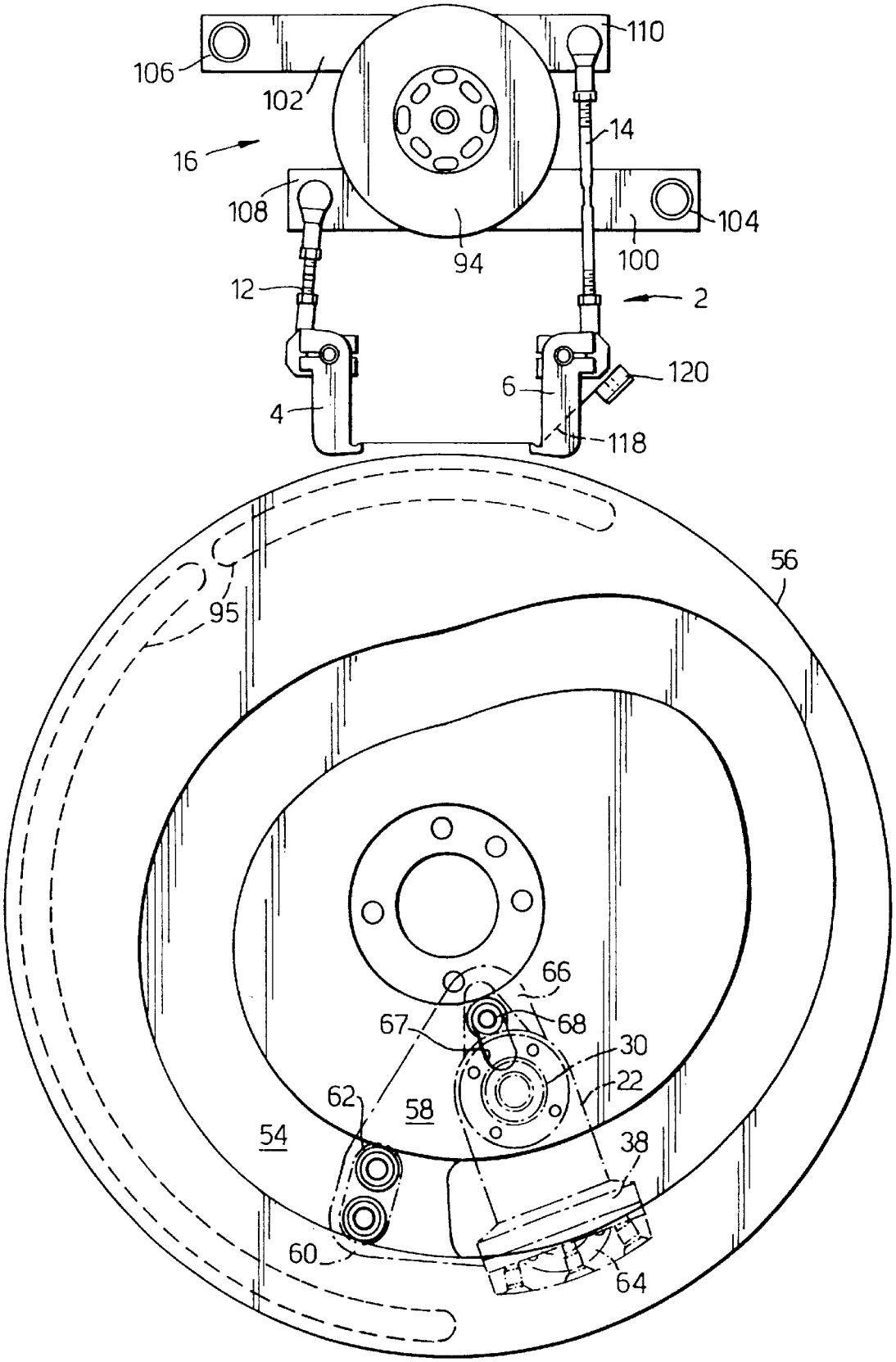
FIG. 3 is an elevational view showing the relative position of the cam track of FIG. 2 in the apparatus of FIG. 1.

As shown in FIGS. 2–4, the motion of the pick-up arms is controlled by means of a fixed cam track 54, comprising a groove in a fixed pad 56, in which a generally triangular slotted link 58 is guided, by means of a pair of cam followers 60 and 62 engaging on opposite sides of the track.

The radially outward corner of the triangular link 58, relative to the pivotal axis 30 of the pick-up arm 22, is also pivotally connected to the drum assembly 18 at 64, and thus, as the assembly rotates, the link 58 is caused to oscillate about the pivot 64 by engagement of the cam followers 60 and 62 with the track 54. Consequently, the radially innermost comer 66 of the link 58 oscillates about the pivot 64, with the rotation of the drum assembly 18, and this corner carries an elongate slot 67 in which is engaged a pin 68 connected to a lever 70. The lever 70 is fixed to one end of a shaft 72 which carries the pick-up arm 22. Consequently, the oscillation of the inner comer 66 of the triangular link 58 is translated by the link 70, via the follower pin 68, to provide a wiping movement for the pick-up arm 22, as explained in more detail below. It will be understood that the other pick-up arms 20, 24 and 26 are mounted on the drum assembly 18 in the same way as the pick-up arm 22.

The motion of the pick-up arms 20 etc may be controlled by other cam and link mechanisms than that shown in the drawings, or by a series of gear wheels.

FIG. 4 illustrates the general arrangement of the mechanism shown in FIGS. 2 and 3 in side elevation, and it will be seen that the inner end of shaft 72 is journalled at 76 in the rotatable inner drum plate 74. The pivot 64 of the slotted link 58 is also journalled in the drum plate 74. Drive is transferred to the inner drum plate 74 by means of an outer casing 78 which is in turn rotated by a main drive pulley 80. A secondary drive pulley 82 drives the stack support finger mechanism, as described in more detail below.

The outer drum plate 84, which supports the other end of the pick-up arm shaft 72 by means of the journal 30, is connected to the inner plate 74 by four fixed struts 85 which respectively carry the support members 44, 46, 48, 50, which each comprise axially spaced elements, as seen in FIG. 4. The drum assembly 18, including the plates 74 and 84, is rotatably supported on a fixed shaft 87. The outer surface of the outer drum plate 84 is in sliding contact, by way of a carbon ring 91, with a fixed frame member 93 which contains an arcuate suction manifold 95 communicating with its face adjacent the drum plate 84. Adjacent each shaft 72 the plate 84 is provided with a port 86 communicating with passages in the shaft and pick-up arm, so as to provide vacuum to a plurality of suction pads 88 carried on the pick-up head 38 at suitable points in the rotation of the drum assembly 18, corresponding to positions where the port 86 is adjacent the manifold 95. For convenience of indicating its arcuate extent relative to the axis of the drum assembly 18 only, the shape of the manifold 95 is indicated in FIG. 3, from which it will be noted that the manifold is in two arcuate sections extending from the region of the magazine 2 to the region of the conveyor 52 (FIG. 1). The suction pads 88 are arranged in circumferential rows separated by blank support guides 89 which have arcuate edges. Each pick-up arm 22 could have a part-cylindrical peripheral surface provided with a series of suction openings which draw a blank against the surface, instead of the arrangement of suction pads 88 and guides 89.

Figure 5:
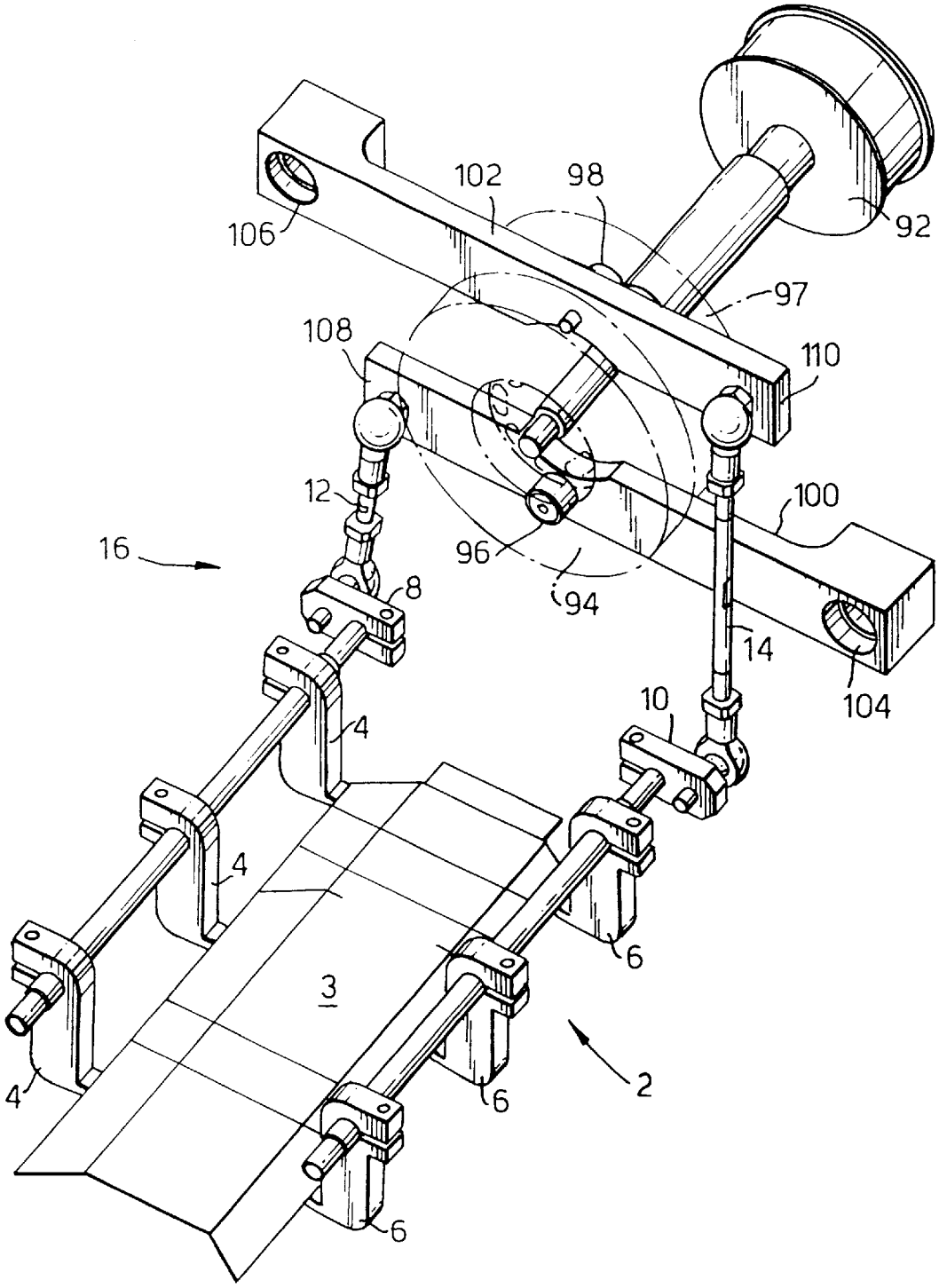
FIG. 5 is a perspective view of a blank support mechanism in the apparatus of FIG. 1.

FIG. 5 illustrates the operation of the stack support fingers 4, 6 of the magazine, the mechanism being driven by a pulley 92 by way of a belt (not shown) passing also around the secondary drive pulley 82 of the drum assembly 18 (FIG. 4).

The pulley 92 drives a disc 94, whose rear surface (as seen in FIGS. 3 and 5) carries a cam track which is engaged by a follower 96 fixed to an actuating arm 100. Similarly, another disc 97 carries a cam track which is engaged by a follower 98 fixed to an actuating arm 102.

The outer ends 104, 106 of the arms 100, 102 are pivoted to fixed points on the apparatus, so that the rotation of the cam discs 94, 97 causes their opposite ends 108, 110, to rise and fall in a predetermined pattern, actuating the links 12 and 14 whose upper ends are in turn pivoted to the ends 108, 1 10. This transfers movement to the leading and trailing sets of support fingers 4 and 6, so as to release the corresponding edges of the blanks 3 in the stack in the required sequence.

Figure 6:
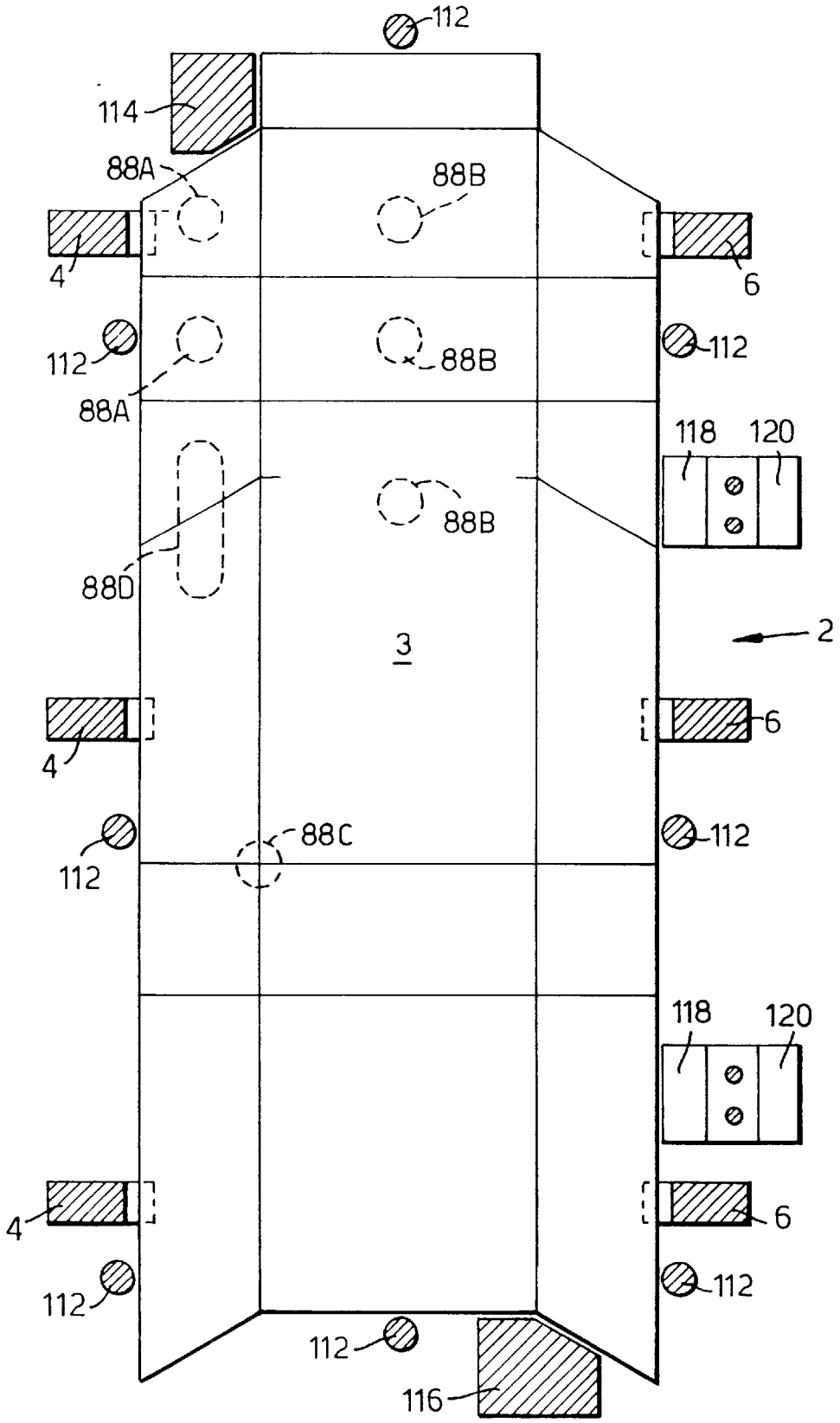
FIG. 6 is a transverse sectional view of a blank magazine of the apparatus of FIG. 1.

Referring particularly to FIG. 6, there are three pairs of stack support fingers 4, 6 at the base of the magazine 2. In addition, the magazine 2 has a number of vertically-extending guide rods 112 placed so as to assist in location of the stack of blanks 3 in the magazine. Further vertically-extending guides 11 4,116, having engagement faces adapted to the shape of the blanks 3, are provided to further aid precise location and prevent any tendency of the lowermost blank to twist as it is received on a pick-up head 36 etc. So as to facilitate this, the lower ends of the guides 114, 116 extend slightly below the level of the lowermost blank when retained by the fingers 4, 6, so as to maintain control of the blank between that level and the pick-up head 36 etc on which the blank is deposited. As a further aid to control of the stack in the magazine 2, a pair of inclined spring steel strips 118 (see also FIG. 3) carried by fixed mounting blocks 120 is provided to engage the trailing edges of the lowermost blanks 3. These help to ensure that only the lowermost blank 3 is released onto each pick-up head 36 etc. Note that it is the trailing edge of each lowermost blank 3 which is first engaged by a pick-up head.

The suction pads 88 (or suction apertures in the part-cylindrical pick-up head described hereinbefore) may engage the blanks at positions related to features of the blanks, e.g. to engage a side flap or main panel or extend across a fold line, as indicated respectively at 88A, B and C in FIG. 6. Particularly where suction apertures are provided, these need not be circular and could, for example, be elongated, as indicated at 88D in FIG. 6. It will be understood that the positions of the pads or apertures 88A–D are indicated in FIG. 6 for reference purposes only and do not indicate a typical or full complement of such positions.

Although three pairs of support fingers 4, 6 have been shown in FIG. 6, two pairs may be sufficient. Particularly in this case, however, the ends of the lowermost blank 3 in the magazine 2 may sag slightly. In order to prevent premature interference between these ends and the corresponding outer elements of the support members 44 etc, the leading ends of the outermost support members may be shortened slightly, as indicated at 44A in FIG. 1.

Figure 7A:
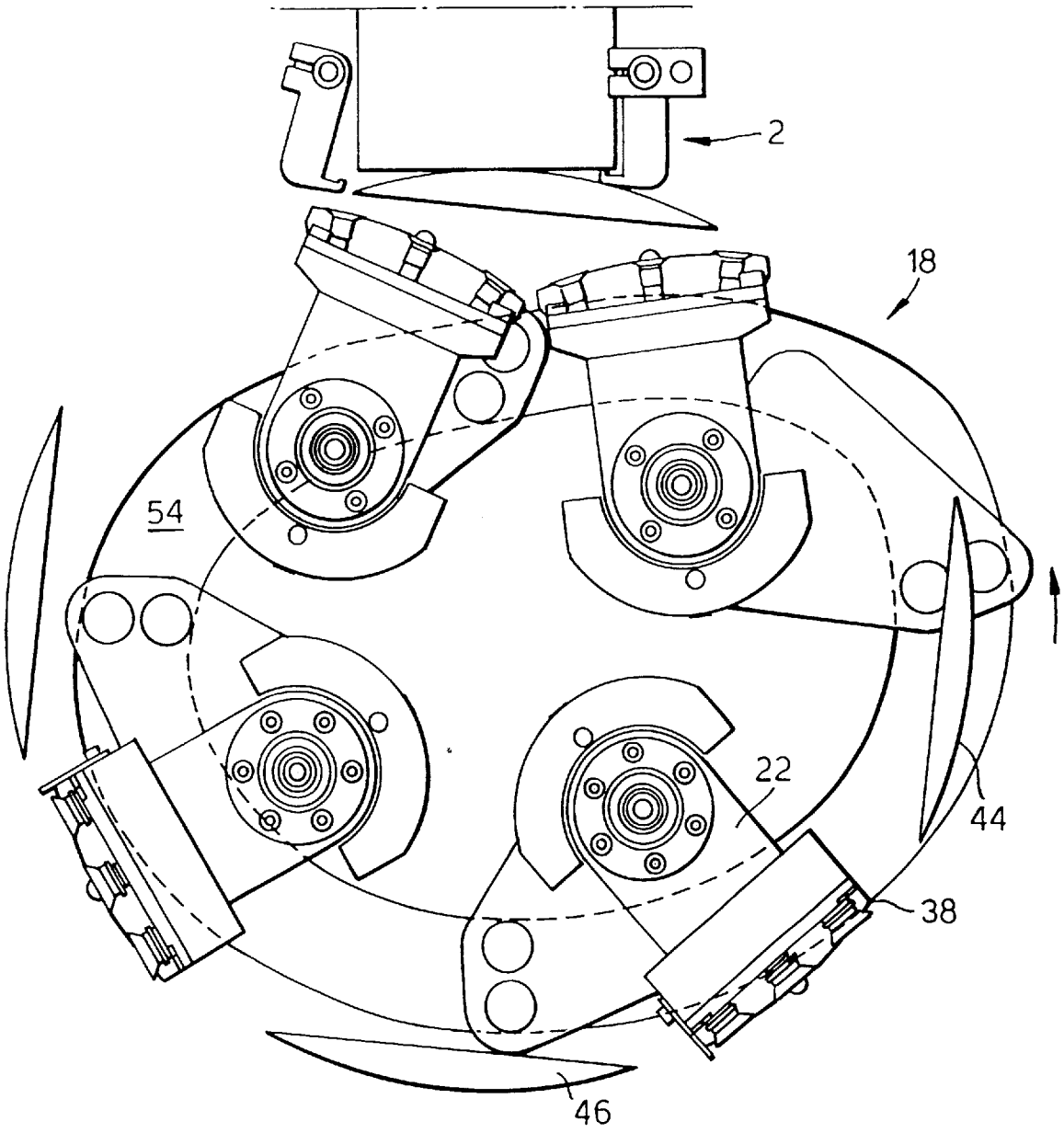
FIGS. 7A to 7G respectively illustrate successive rotational positions of a blank feed mechanism in the apparatus of FIG. 1.
Figure 7B:
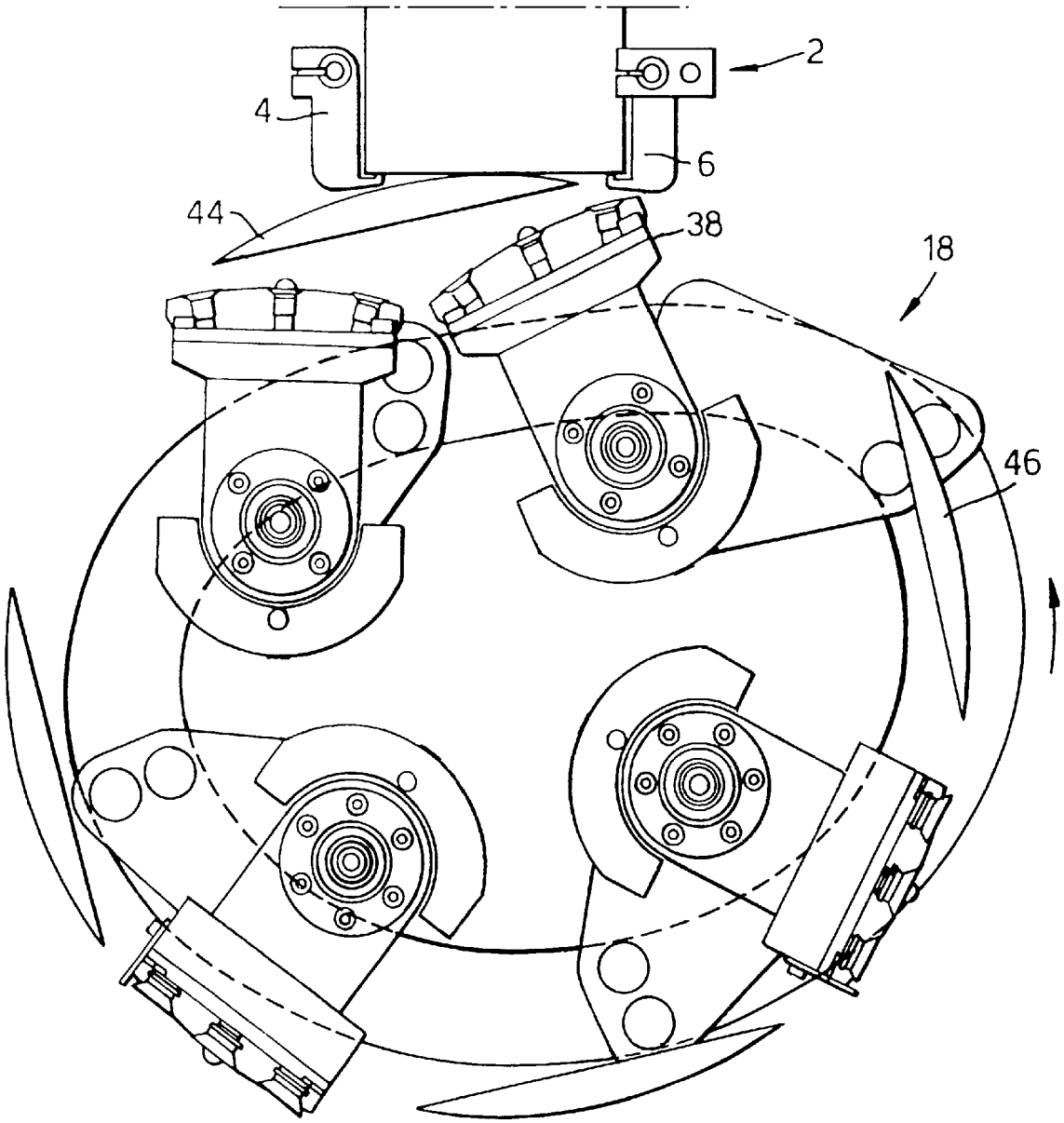

The sequence of pick-up operations is illustrated in FIGS. 7A to 7G by reference to movement of one pick-up head 38. FIG. 7A shows the pick-up head 38 in a radially oriented position, i.e. in which the pick-up head is exactly midway between the two adjacent support members 44 and 46. With the drum assembly 18 rotating in the counter-clockwise direction as seen in the figures, FIG. 7B shows the pick-up head 38 rotating forward as it approaches the bottom of the blank stack in the magazine 2. At this point the stack is being supported by the leading support member 44, as well as the leading and trailing stack support fingers 4 and 6.

Figure 7C:
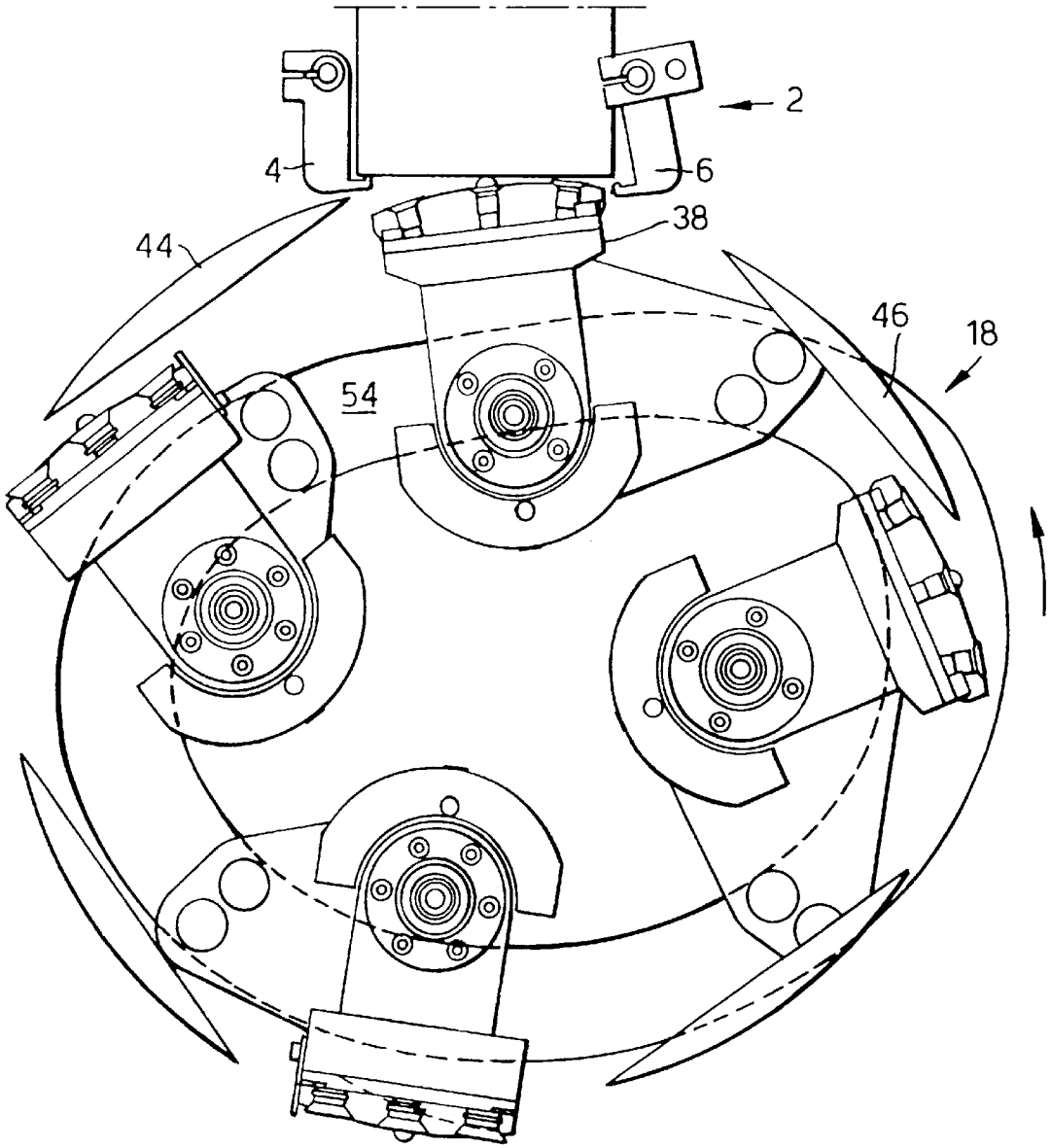

As the drum assembly 18 rotates further, towards the position shown in FIG. 7C, it will be seen that the shape of the cam track 54 at this rotational position is such that the pick-up head 38 begins to rotate in the opposite (i.e. reverse) direction, as it engages with the underside of the lowermost blank in the magazine 2, and at this point vacuum will be supplied to the pick-up head, while the trailing stack support fingers 6 are disengaged from the corresponding edge of the stack, under control of the cam mechanism 16.

Figure 7D:
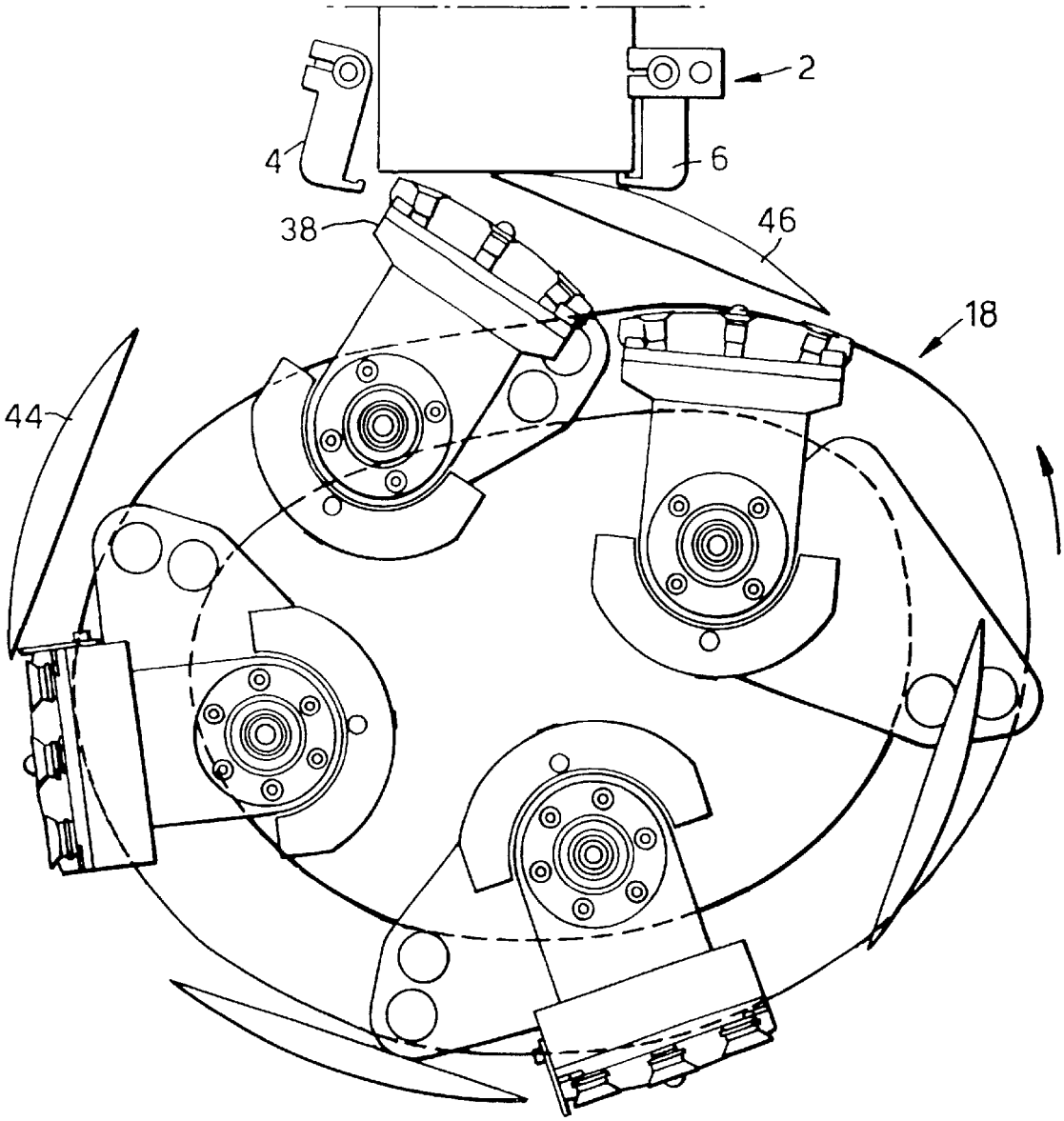

In the position shown in FIG. 7D the pick-up head has rotated further in the reverse direction, and peeling of the lowermost bank continues, so that the removal of the trailing edge of the lowermost blank from the stack enables the trailing support fingers 6 to be moved back into engagement with the remaining blanks. At the same time, the trailing support member 46 begins to engage under the central part of the remainder of the stack, while the leading support finger is retracted to release the leading edge of the current blank on to the pick-up head 38. Note that conveyed blanks are not shown in FIG. 7.

Figure 7E:
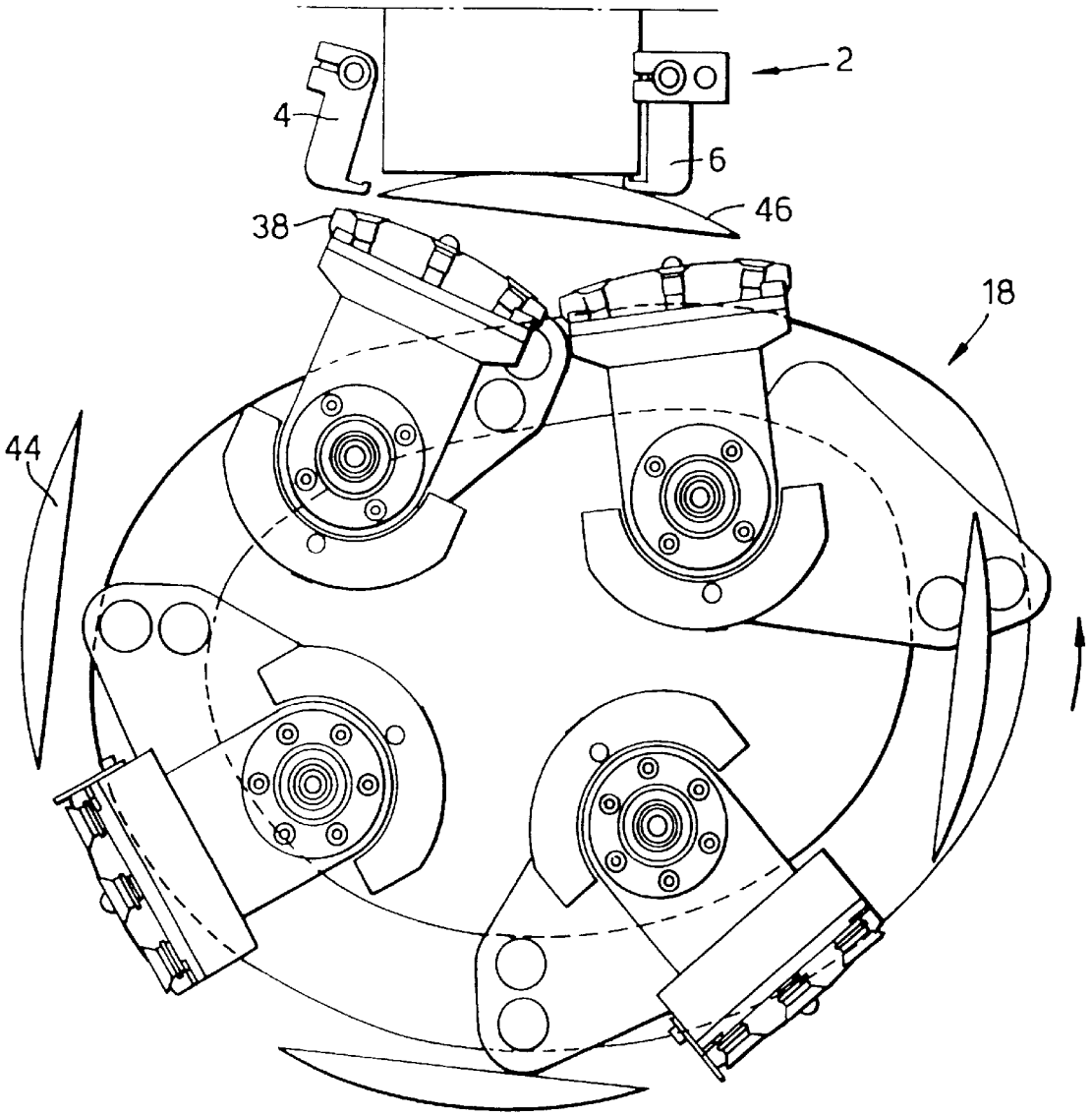
Figure 7F:
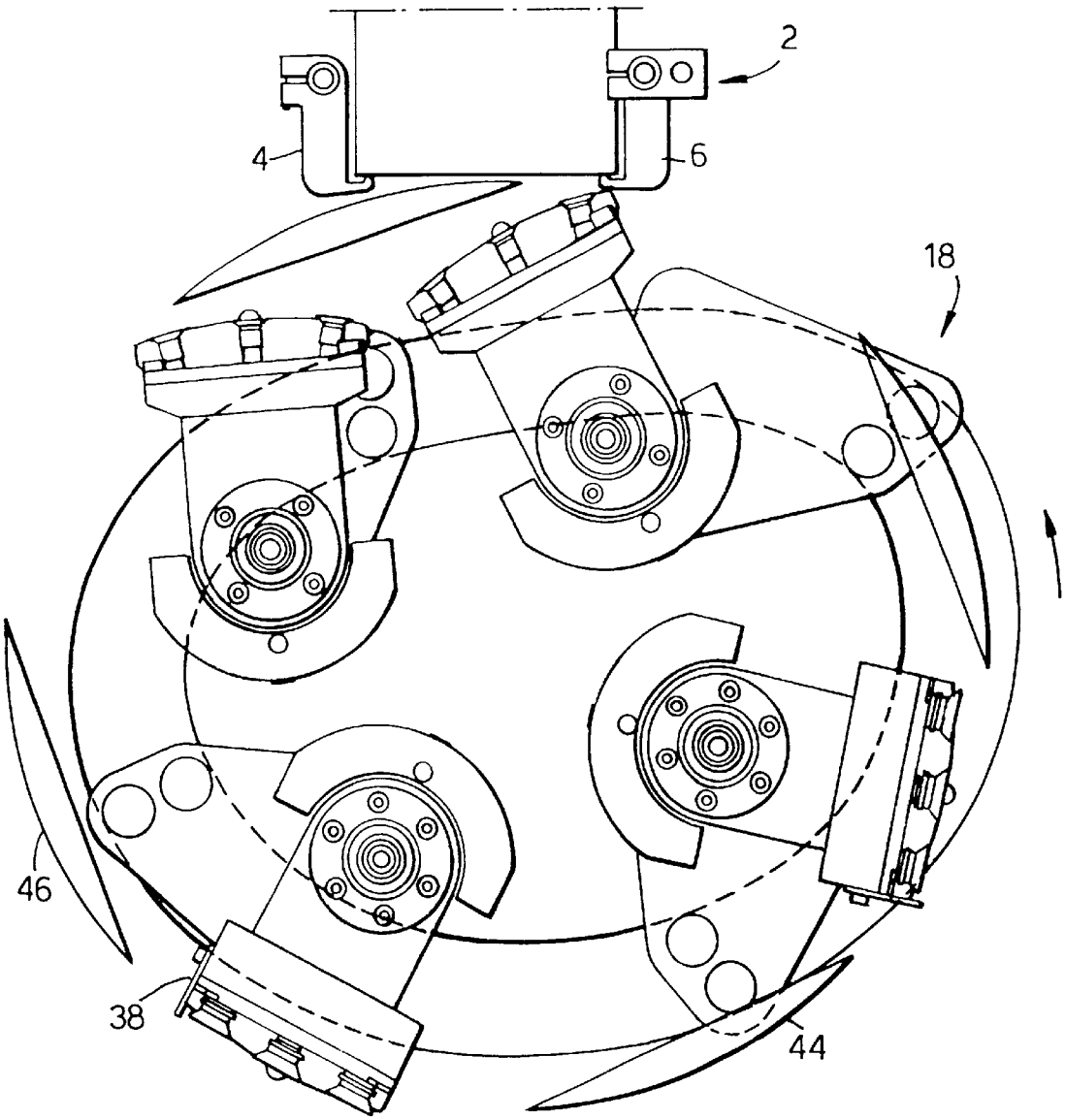
Figure 7G:
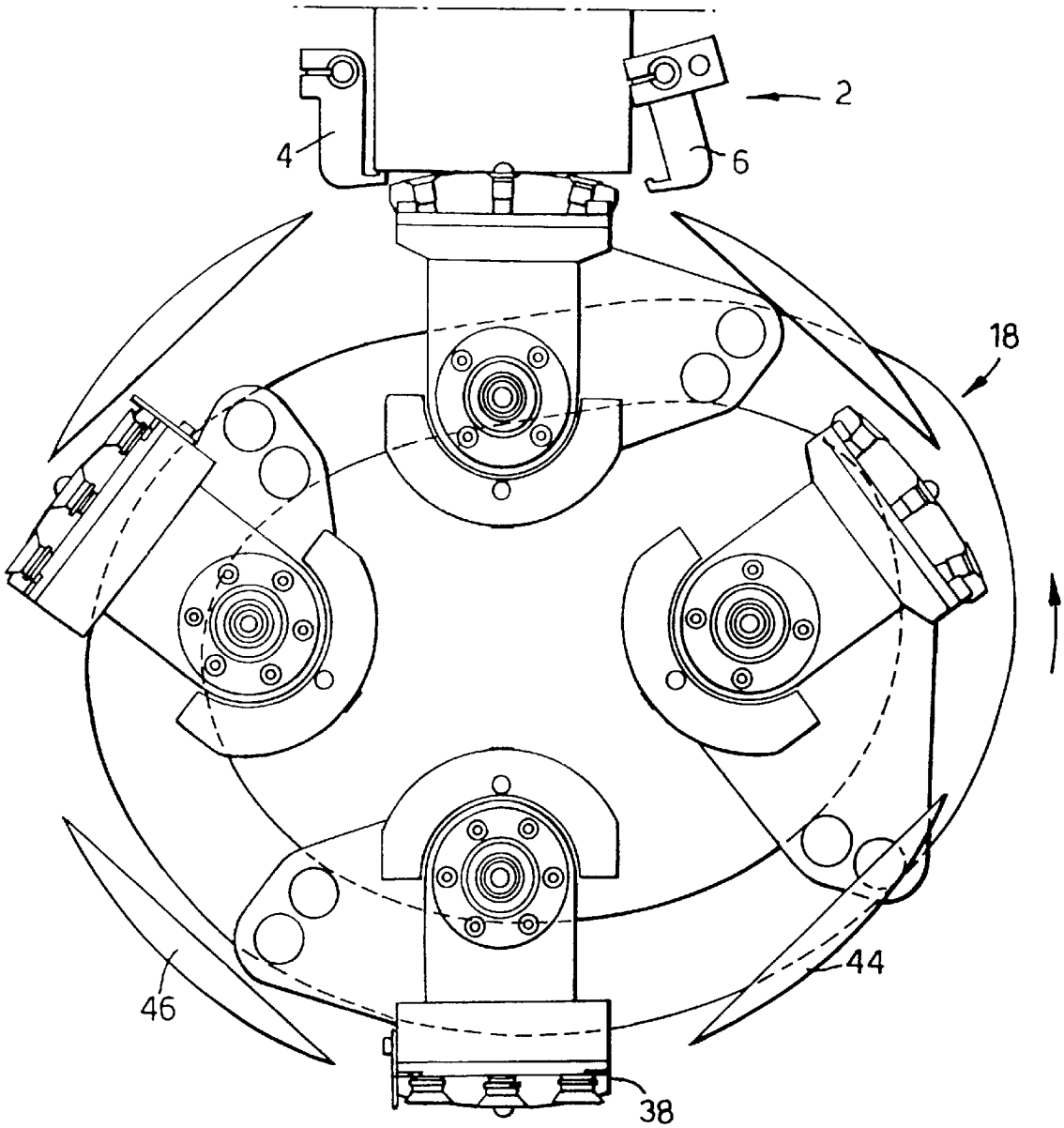

In the position of FIG. 7E the peeling of the current blank is complete, and the pick-up head 38 begins to rotate forwards again, towards the radial position, while the stack is supported by the guide 46, and subsequently, in the position shown in FIG. 7F, the leading support fingers 4 are re-engaged with the stack, while the pick-up head is approaching the point of delivery of the blank onto the discharge conveyor 52 (FIG. 1). Finally, in the position shown in FIG. 7G, the pick-up head 38 has reached the radial position, and the blank is released onto the discharge conveyor 52.

It will be understood that, by providing the suction manifold 95 in two parts, it is possible to provide suction separately to these parts and hence, when required, suction could be turned off in the region of the magazine 2, so that no further blanks 3 are picked up, while blanks already picked up are conveyed to the conveyor 52. This may be useful in providing an ordered shut-down of the apparatus.

The fingers 4, 6 are pivoted above the level of the lowermost blank 3 in the stack 2 such that the motion of the supporting parts of the fingers towards and away from their supporting positions are substantially horizontal. As a consequence, it is important that the respective edges of the next-to-lowermost blank should not fall significantly after the lowermost blank has been released but before the fingers 4, 6 return from their retracted positions, otherwise the fingers will be unable to engage below this blank and may even damage it on their return. The support members 42 etc assist in maintaining the position of the next-to-lowermost blank. Maintaining its position can be made less critical if the support fingers are arranged to move upwards during the final stage of their return to the stack support positions. One way of achieving this, at least in part, is to shorten the fingers 4, 6 and/or lower their pivot axes. Alternatively, fingers, which need not necessarily be pivoted, could be moved on a closed loop path on which they are withdrawn in a substantially horizontal direction but returned on a path which has a final upward portion, so that if a blank has fallen slightly the fingers will engage under and lift it. A cam-controlled pivoted link mechanism could achieve this motion path for the fingers.

What is claimed is:

1. Apparatus for handling blanks comprising a magazine for receiving a stack of blanks and including means for supporting the stack, endless conveyor means for receiving successive lowermost blanks from the stack, said conveyor means including at least one blank pick-up device arranged to receive and convey blanks from the stack, and support means carried by the endless conveyor means for at least partly supporting the stack between pick-up operations of said pick-up device, wherein the endless conveyor means carries a plurality of spaced pick-up devices between which are arranged a plurality of spaced support members, wherein the endless conveyor means comprises a rotary member rotatable about an axis which is parallel to a plane in which the lowermost blank in the stack extends, and wherein said support members include laterally-spaced regions having leading edges which are spaced in the direction of conveyance, so as to accommodate different levels of parts of the lowermost blank corresponding to said regions.

2. Apparatus as claimed in claim 1, including means for driving the endless conveyor means continuously.

3. Apparatus as claimed in claim 1, wherein said support members include arcuate surfaces at least approximately co-axial with the axis of said rotary member and arranged to engage successive lowermost blanks in the stack.

4. Apparatus as claimed in or claim 3, wherein the support members and pick-up devices are so disposed as to allow a support member to engage the stack during a pick-up operation.

5. Apparatus as claimed in claim 1, wherein said support members comprise a plurality of laterally-spaced elements contacting the blanks at laterally-spaced regions.

6. Apparatus as claimed in claim 1, wherein each pick-up device includes an arm pivoted about an axis parallel to said axis, including control means for controlling the angular position of the arm as said rotary member rotates about said axis.

7. Apparatus for handling blanks comprising a magazine for receiving a stack of blanks and including means for supporting the stack, endless conveyor means for receiving successive lowermost blanks from the stack, said conveyor means including at least one blank pick-up device arranged to receive and convey blanks from the stack, wherein said endless conveyor means comprises a rotary member rotatable about an axis and said pick-up device includes an arm pivoted about an axis parallel to said axis, and control means for controlling the angular position of the arm as said rotary member rotates about said axis, wherein the control means comprises a follower carried by each device and a fixed cam track extending around the axis of said rotary member, and wherein each follower is connected to each arm by means including a pivoted link arrangement.

8. Apparatus as claimed in claim 7, wherein said control means is arranged to reciprocate each arm about said pivot axis during rotation of said rotary member.

9. Apparatus as claimed in claim 7, wherein said control means is arranged to pivot each arm in the region of said magazine from a forward position, in which the arm is angularly in advance of a radial position relative to the axis of said rotary member, to a rearward position, in which said arm is angularly retarded from a radial position relative to said axis.

10. Apparatus as claimed in claim 7, wherein each pick-up device includes a peripheral arcuate surface for receiving a blank, said control means being arranged so that each arm is moved in the region of said magazine so that said arcuate surface performs a rolling action relative to the stack to receive a lowermost blank.

11. Apparatus for handling blanks comprising a magazine for receiving a stack of blanks and including means for supporting the stack, endless conveyor means for receiving successive lowermost blanks from the stack, said conveyor means including at least one blank pick-up device arranged to receive and convey blanks from the stack, and support means carried by the endless conveyor means for at least partly supporting the stack between pick-up operations of said pick-up device, wherein said at least one blank pick-up device includes means defining a peripheral arcuate surface, including a plurality of spaced means each defining at least one suction aperture and at least one intermediate region for supporting a blank, and wherein said spaced regions are arranged in a predetermined pattern disposed so as to correspond with predetermined features of a blank.

12. Apparatus as claimed in claim 11, including port means movable with said endless conveyor means and arranged to cooperate with at least one stationary suction manifold so as to supply suction to said suction apertures during a predetermined portion of the path of said pick-up device.

13. Apparatus as claimed in claim 12, wherein said suction manifold includes a first region at a position corresponding to movement of the pick-up device past said magazine, and a second region downstream of said first region, and means for selectively applying suction to said suction manifold, whereby suction may be supplied to said first and second regions or to said second region alone.

14. Apparatus for handling blanks comprising a magazine for receiving a stack of blanks and including means for supporting the stack, endless conveyor means for receiving successive lowermost blanks from the stack, said conveyor means including at least one blank pick-up device arranged to receive and convey blanks from the stack, and support means carried by the endless conveyor means for at least partly supporting the stack between pick-up operations of said pick-up device, wherein the means for supporting the stack at the magazine comprises means for supporting opposed edges of the lowermost blank of the stack.

15. Apparatus as claimed in claim 14, wherein said supporting means comprises retractable elements respectively at the leading and trailing edges of a lowermost blank, and means for sequentially retracting said elements in synchronism with movement of a pick-up device to receive said -lowermost blank.

16. Apparatus for handling blanks comprising a magazine for receiving a stack of blanks and including means for supporting the stack, endless conveyor means for receiving successive lowermost blanks from the stack, said conveyor means including at least one blank pick-up device arranged to receive and convey blanks from the stack, said supporting means including means for supporting opposed edges of the lowermost blank of the stack including retractable elements respectively at the leading and trailing edges of a lowermost blank, and means for sequentially retracting said elements in synchronism with movement of the pick-up device to receive said lowermost blank.

17. Apparatus as claimed in claim 16, wherein said elements comprise pivotally mounted support fingers.

18. Apparatus as claimed in claim 16, wherein said retractable elements are connected to cam operated pivoted link mechanisms to produce said sequential retraction of said elements.

19. Apparatus as claimed in claim 18, wherein the supporting means includes a resilient device arranged to engage the trailing the edge of the lowermost blank in the stack, said device being disposed to release the lowermost blank but retain the next-to-lowermost blank on each operation of said pick-up device.

20. Apparatus as claimed in claim 19, wherein said resilient device includes at least one spring strip having a free edge engaging the trailing edge of the lowermost blank in the stack.

21. Apparatus as claimed in claim 16, including downwardly-extending guide means providing lateral support for the stack in said magazine, said guide means including first and second spaced elements located at diagonally opposed regions of the magazine and adapted to inhibit twisting of a blank during transfer to a pick-up device.

22. Apparatus as claimed in claim 20, wherein said elements extend slightly below the level of the supporting means.

23. Apparatus for handling blanks comprising a magazine for receiving a stack of blanks and including means for supporting the stack, a rotary conveyor member rotatable about an axis, said conveyor member including a plurality of angular spaced pick-up devices each operable to pick-up a sheet from the bottom of said stack and to retain said sheet against the circumference of said conveyor member so that said sheet can be conveyed while held against said circumference from said stack to a release position spaced circumferentially from said stack, and support means carried by the conveyor member for at least partially supporting the stack between pick-up operation.

24. Apparatus according to claim 23, wherein each pick-up device includes an arm which is pivotable about an axis parallel to the conveyor member axis and control means for controlling the angular position of the arm as the conveyor member rotates so that as a pick-up device operates to receive a sheet from said stack a support means is moving to a position to support the stack.

25. Apparatus according to claim 23, wherein each pick-up device includes a pick-up head with an outer surface whose radius of curvature corresponds substantially to that of the rotary conveyor member.

26. Apparatus according to claim 25, wherein each pick-up head includes a plurality of suction elements distributed over the surface of the head.

27. Apparatus for handling blanks, comprising a magazine for receiving a stack of blanks and including means for supporting the stack, a rotary conveyor member rotatable about an axis, said conveyor member including a plurality of angularly spaced pick-up devices operable to pick-up a sheet from the bottom of said stack, and support means carried by the conveyor member for at least partially supporting the stack between pick-up operations wherein each pick-up device include an arm which is pivotable about an axis parallel to the conveyor axis, a cam follower which follows a cam track extending around the axis of the rotary conveyor member and configured such that when the pick-up device is in the vicinity of the stack the arm is caused to undergo a forward and rearward movement relative to a radius of the conveyor member and during the remainder of its rotation with the conveyor member the arm maintains a substantially fixed radial orientation.

* * * * *